US009877541B2

(12) United States Patent
Castellano

(10) Patent No.: US 9,877,541 B2
(45) Date of Patent: Jan. 30, 2018

(54) METHOD TO PREVENT IRRITATION OF DEFORMED TOES OF A PATIENT USING AN ADJUSTABLE TOE PROTECTOR

(71) Applicant: Evenup LLC, Hoschton, GA (US)

(72) Inventor: Bradley D. Castellano, Hoschton, GA (US)

(73) Assignee: Evenup LLC, Alva, FL (US)

( * ) Notice: Subject to any disclaimer, the term of this patent is extended or adjusted under 35 U.S.C. 154(b) by 0 days.

(21) Appl. No.: 15/212,743

(22) Filed: Jul. 18, 2016

(65) Prior Publication Data

US 2017/0112230 A1 Apr. 27, 2017

Related U.S. Application Data

(63) Continuation of application No. 14/258,888, filed on Apr. 22, 2014, now abandoned.

(60) Provisional application No. 61/843,273, filed on Jul. 5, 2013.

(51) Int. Cl.
*A43B 7/14* (2006.01)

(52) U.S. Cl.
CPC ..... *A43B 7/149* (2013.01); *A43B 7/145* (2013.01); *A43B 7/147* (2013.01)

(58) Field of Classification Search
CPC .... A61F 5/019; A61F 5/05875; A61F 5/0118; A61F 13/0273; A61F 13/06; A61F 13/065; A61F 13/068; A61F 13/062; A61F 2013/00093; A61F 2013/15008; A43B 7/149; A43B 7/145; A41F 9/025
USPC ..... 602/30, 64, 75, 21, 22, 61–63; 36/8.3; 128/893, 882; 24/306, 20 EE; 2/16, 170, 2/338
See application file for complete search history.

(56) References Cited

U.S. PATENT DOCUMENTS 903,761 A * 11/1908 Paroubek ..... A61F 5/0118 128/DIG. 23
2,888,013 A * 5/1959 Levitt ..... A61F 5/019 128/894
3,110,306 A * 11/1963 Posner ..... A61F 5/019 128/894
3,234,936 A * 2/1966 Levitt ..... A61F 13/068 602/30
4,414,964 A * 11/1983 Farino ..... A61F 13/068 128/894
4,644,940 A * 2/1987 Nakamura ..... A61F 5/019 128/882
4,896,402 A * 1/1990 Jansen ..... B21D 53/36 24/20 EE
4,940,046 A * 7/1990 Jacoby ..... A61F 5/019 128/882
5,329,638 A * 7/1994 Hansen ..... A41D 13/088 2/16

(Continued)

*Primary Examiner* — Sally Haden
*Assistant Examiner* — Jillian K Pierorazio
(74) *Attorney, Agent, or Firm* — Adrian D. Battison; Ade & Company Inc.; Ryan W. Dupuis

(57) ABSTRACT

A method to prevent irritation of deformed toes of a patient uses an adjustable toe protector formed from a loop of a tubular material with a pile layer on the inside where the length of the loop is adjustable, and pads the top the toes with a double thickness of the material so that shoe pressure straightens the toe out while a crest pad formed by a resilient insert into the tubular material beneath the toe lifts the toes.

4 Claims, 2 Drawing Sheets

(56) References Cited

U.S. PATENT DOCUMENTS 5,497,789 A * 3/1996 Zook ..... A61F 13/063 128/893
5,664,258 A * 9/1997 Harris ..... A41D 3/08 2/69
5,921,949 A * 7/1999 Dray ..... A61F 5/0118 2/162
6,053,169 A * 4/2000 Hunt ..... A61F 5/05841 128/876
6,120,472 A * 9/2000 Singer, Jr. ..... A61F 13/108 602/20
6,415,795 B1 * 7/2002 Kew ..... A61F 13/065 128/869
6,478,760 B2 * 11/2002 Darcey ..... A61F 13/04 602/1
6,506,175 B1 * 1/2003 Goldstein ..... A61F 13/06 602/60
6,589,272 B1 * 7/2003 Sheikh ..... A61F 7/02 607/108
6,807,680 B2 * 10/2004 Sloot ..... A01K 11/00 119/857
6,823,870 B1 * 11/2004 Hill ..... A61F 5/3776 128/869
D503,806 S * 4/2005 Williams ..... D24/190
7,286,055 B2 * 10/2007 Girvin ..... G06K 19/07381 340/572.3
8,628,488 B2 * 1/2014 Serola ..... A61B 17/1325 128/846
8,793,841 B2 * 8/2014 DeBerry ..... A44B 11/12 24/23 R
2004/0134501 A1 * 7/2004 Hargis ..... A61F 5/0109 128/882
2005/0150033 A1 * 7/2005 Stude ..... B62B 5/068 2/338
2006/0032032 A1 * 2/2006 Cheng ..... F16L 3/23 24/306
2008/0071205 A1 * 3/2008 Howard ..... A61F 5/0118 602/21
2008/0104739 A1 * 5/2008 Kharazmi ..... A41D 20/00 2/170
2010/0236030 A1 * 9/2010 Dyer ..... B65D 63/1063 24/16 PB
2011/0108045 A1 * 5/2011 Racz ..... A45D 29/00 132/73
2011/0208239 A1 8/2011 Stone et al.
2013/0014350 A1 * 1/2013 Lie ..... B65D 63/1018 24/16 PB
2013/0079694 A1 3/2013 Aquino
2014/0188024 A1 * 7/2014 Cox ..... A61F 5/01 602/20

* cited by examiner 1
1A
1B
2
3
4
5
6
24
25

METHOD TO PREVENT IRRITATION OF DEFORMED TOES OF A PATIENT USING AN ADJUSTABLE TOE PROTECTOR

This application is a continuation application of application Ser. No. 14/258,888 filed Apr. 22, 2014 and now abandoned.

This application claims the benefit under 35 USC 119(e) of Provisional Application 61/843,273 filed Jul. 5, 2013.

This invention relates to a method to prevent irritation of deformed toes of a patient.

BACKGROUND OF THE INVENTION

One arrangement of this type is shown in US Application 2013/0079694 published Mar. 28, 2013 by Aquino. Another similar arrangement which is not a subject of a patent application is available on the market by Pedifix of Brewster N.Y.

These and other commercially available toe crest or buttress pads of this type do not address irritation of the shoe against the top of the deformed toes.

SUMMARY OF THE INVENTION

According to the invention there is provided a method to prevent irritation of deformed toes of a patient comprising:

shaping a band having a length to wrap around a plurality of the toes of the patient to form a loop defining a top loop portion for extending across the top of the toes and a bottom loop portion for extending underneath the toes;

the band comprising an elongate tubular member with an exterior tubular wall forming a hollow interior;

the band having a first end at a first end of the tubular member and a second end at a second end of the tubular member;

wherein the second end of the tubular member defines an open mouth at the second end which forms an entrance into the hollow interior of the tubular member into the hollow interior of the tubular member;

passing a first portion of the tubular member at the first end through the entrance defined by the open mouth at the second end so that said first portion extends along the hollow interior from the open mouth to a position spaced from the open mouth of the second end;

causing said first end to emerge through a hole in the exterior wall at said position to define the loop with an end portion of the first end projecting out of said hole in the exterior wall so as to define a tail which can be pulled to tighten the loop;

the top loop portion of the tubular member thus extending between the open mouth at the second end and said hole at said position spaced from the open mouth at the second end with said first portion of the first end extending inside the top portion of the second end to form said top loop portion as a part of the loop which is thicker than the bottom loop portion;

and wrapping the loop around a plurality of toes of the patient so that the top loop portion extends across on top of the plurality of toes and so that the bottom loop portion lies underneath the plurality of toes.

Preferably the tubular member is formed of a fleece material with a pile layer in an inner surface.

Preferably the pile layer is at least partly removed at said connecting portions so that the connecting portions are thinner than the top and bottom portions.

Preferably a resilient padding member is inserted into the hollow interior at least at the bottom portion.

Preferably a resilient padding member is inserted into the hollow interior only at the bottom portion.

Preferably the hole is defined by a slit in the tubular material.

Preferably the top portion is defined by a first end portion at the first end lying inside a second end portion at the second end so that the first and second end portions overlap to define a thicker part of the loop at the top portion.

According to a second aspect of the invention there is provided an apparatus for application to the toes of a patient comprising:

a band comprising a loop having a length to wrap around a plurality of the toes of the patient;

the loop defining a top portion extending across the top of the toes and a bottom portion to extend underneath the toes;

the loop having two connecting portions one at each end each joining the top portion so as to extend between two toes;

the band comprising an elongate tubular member with a hollow interior;

wherein the tubular member is formed of a fleece material with a pile layer on an inner surface.

According to a third aspect of the invention there is provided an apparatus for application to the toes of a patient comprising a band comprising a loop having a length to wrap around a plurality of the toes of the patient;

the loop defining a top portion extending across the top of the toes and a bottom portion to extend underneath the toes;

the loop having two connecting portions one at each end each joining the top portion so as to extend between two toes;

the band comprising an elongate tubular member with a hollow interior;

wherein the top portion is defined by a first end portion at the first end lying inside a second end portion at the second end so that the first and second end portions overlap to define a thicker part of the loop at the top portion.

This modified toe buttress pad of the present invention is adjustable and pads the top the toes so that shoe pressure straightens the toe out while crest pad beneath the toe works the same as the other devices currently on the market.

As stated above, prevents irritation of deformed toes. The invention claimed here solves this problem.

Provides padding and buttressing of deformed toe to prevent irritation or callus formation over the joint or at the tip of the toe.

No padding or "buttressing" of the top of the toe exists in the devices used most commonly today This modified toe buttress pad is adjustable, and pads the top the toes so that shoe pressure straightens the toe out while crest pad beneath the toe works the same as other devices currently on the market.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figures 1, 2, 3, 4, 5:
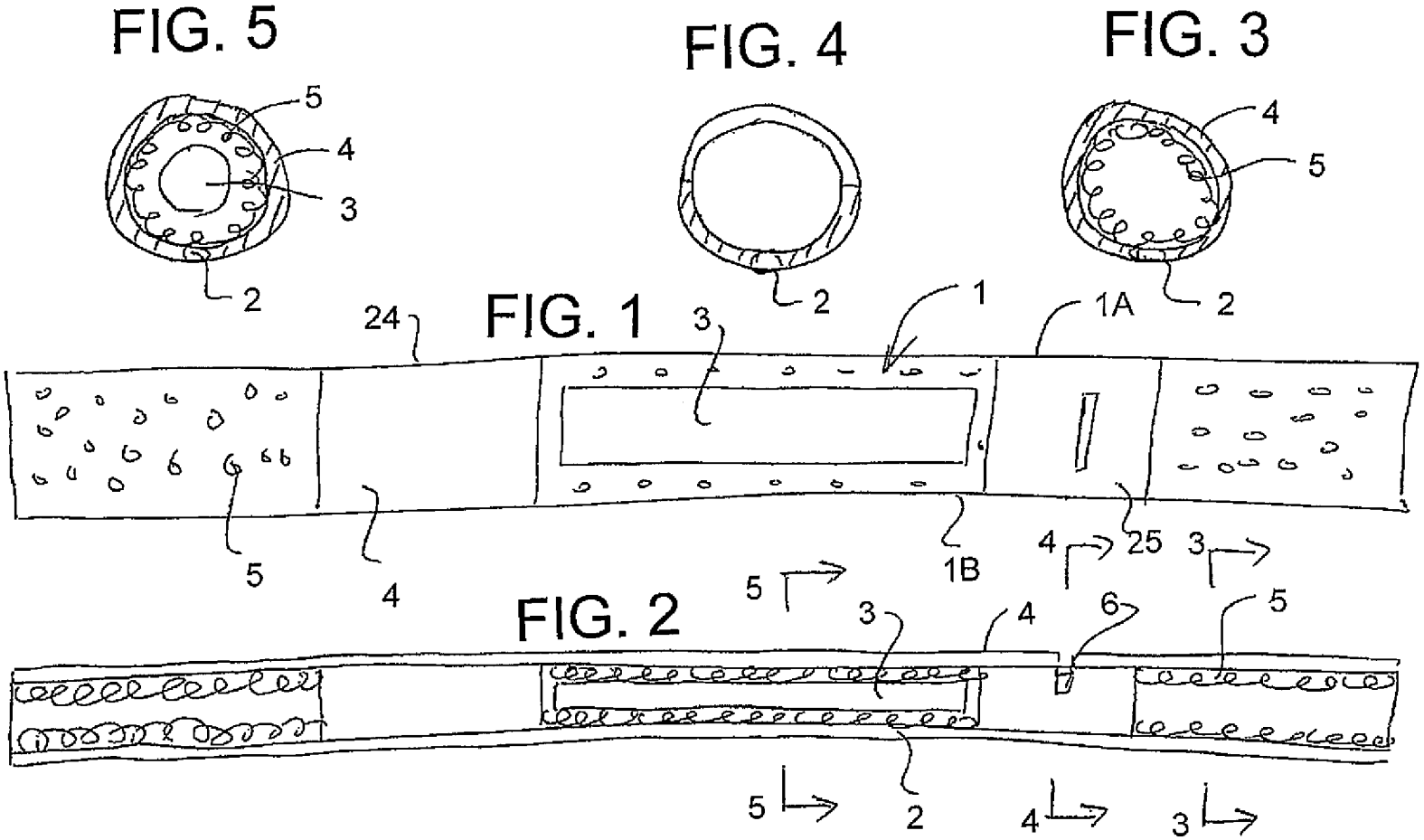
FIG. 1 is a plan view of the rectangular pad of fleece material which is formed into the pad according to the present invention.
FIG. 2 is a longitudinal cross-sectional view of the components of FIG. 1.
FIG. 3 is a cross-sectional view along the lines 3-3 of FIG. 2.
FIG. 4 is a cross-sectional view along the lines 4-4 of FIG. 2.
FIG. 5 is a cross-sectional view along the lines 5-5 of FIG. 2.

The pad of the present invention is formed from a rectangular sheet shown in FIG. 1 of a man-made fleece material commonly known as "sherpa fleece". The rectangular sheet 1 is sewn along adjacent side edges 1A, 1 B to form a seam 2 which shapes the sheet into a tubular configuration shown in FIG. 2. A foam pad 3 is inserted into the tubularized sherpa fleece. The fleece has an outer carrying layer 4 and an inner fleece or pile layer 5.

Figure 6:
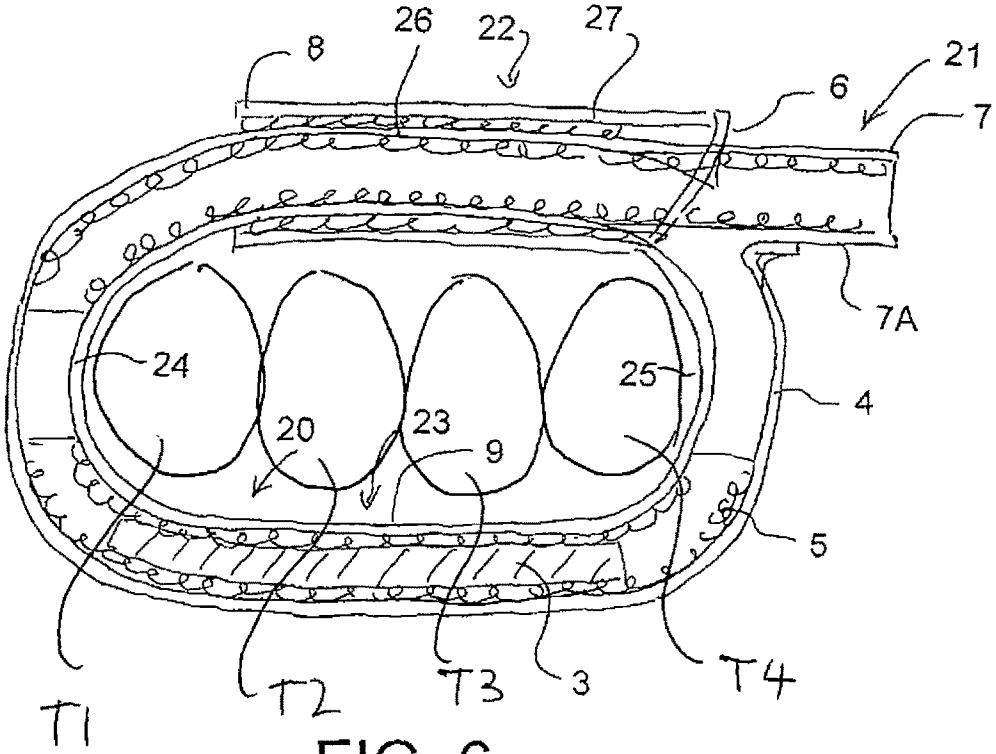
FIG. 6 is a longitudinal cross-sectional view of the pad of FIG. 2 when folded into the required shape.

The apparatus thus provides a loop 20 wrapped around the toes with a tail 21 exposed at one end of the loop. The loop has a length to wrap around a plurality of the toes of the patient. The loop defines a top portion 22 extending across the top of the toes and a bottom portion 23 to extend underneath the toes with two connecting portions 24, 25 one at each end each joining the top portion so as to extend between two toes. The band has a first end and 7 a second end 8 and comprises an elongate tubular member with a hollow interior. As shown in FIG. 6, the first end 7 is inserted into the hollow interior of the second end 8 and emerges through a hole 6 adjacent the second end to define the loop 20 with the first end 7 defining the tail 21 which can be pulled to tighten the loop.

As shown in FIG. 1, the pile layer 5 is at least partly removed at the connecting portions 24, 25 so that the connecting portions are thinner than the top and bottom portions. A resilient padding member 3 is inserted into the hollow interior at least and preferably only at the bottom portion to provide the support for In this construction the top portion 22 is defined by a first end portion 26 at the first end 7 lying inside a second end portion 27 at the second end 8 so that the first and second end portions overlap to define a thicker part of the loop at the top portion.

The tube so formed and shown in Figures is folded and inserted into itself and pulled through a slit 6 made in the tube so that the end 7 is wrapped around to the end 8 of the tube and inserted into the end 8 until the end 7 is pulled out of the slit 6. This provides an end piece 7A which projects out of the slit 6 so as to be exposed which allows the device to be tensioned for fit and comfort by pulling the end 7A to increase or decrease the size of the loop encircling the toes of the wearer.

The fleece material creates a padding of the toes dorsally just behind the first joint in the toe to prevent the shoe from rubbing on the bent joint. This pushes down on the toe and helps to straighten the joint of toes that are flexibly contracted. The padding within the tube fills the space under the toes to push the end of the upward thereby straightening the flexible toe or holding the rigidly deformed toe away from the weight-bearing surface. The method of folding and inserting the fleece in to itself and leaving a long tail allows the device to be adjusted to a snug fit about the toes that are encircled. This method is what is unique to this buttress pad.

The fleece is cut into a rectangular shape of the desired dimensions. The fleece is removed in two areas to thin the material that will ultimately lie between the toes. The material is then sewn along one long side to create a tube. The material is then inverted so that the woolly portion or pile layer is inside the tube and the faux suede material is outside. A foam pad is then drawn into the tube to the appropriate position. Near one end of the tubular material a slit 6 is cut about half way through the tube. A grasping tool is then introduced into the slit and exits the tube at the end closest to the slit. The other end of the tube is grasped with the same tool and then drawn into the opposite end and out the slit opening.

Instructions on how to tighten or loosen the device drawn onto the material are provided where the person encircles the deformed or painful toes in the circle formed by the device and pulls on the loose end to tighten it to comfort. Thus user wraps the loop around a plurality of toes T1, T2, T3 and T4 of the patient so that the top loop portion 22 extends across on top of the plurality of toes and so that the bottom loop portion 23 lies underneath the plurality of toes.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method to prevent irritation of deformed toes of a patient comprising:

shaping a band having a length to wrap around a plurality of the toes of the patient to form a loop defining a top loop portion for extending across the top of the toes and a bottom loop portion for extending underneath the toes and first and second side loop portions connecting the top loop portion and the bottom loop portion;

the band having a first end and a second end;

the band comprising an elongate tubular member with an exterior tubular wall forming a hollow interior;

the exterior tubular wall and the hollow interior extending longitudinally of the band from the second end of the band to a position at or adjacent the first end;

wherein the tubular member at the second end of the band defines an open mouth transversely across the second end of the band which mouth forms an entrance into the longitudinally extending hollow interior of the tubular member;

inserting the first end of the band into the entrance defined by the open mouth at the second end of the band so that an interior portion of the band at the first end of the band extends longitudinally along the hollow interior of the band from the open mouth at the second end of the band to a positon spaced longitudinally along the band from the open mouth;

forming a hole in the exterior wall at said position spaced from said open mouth so as to form an exterior portion of the band between the open mouth and the hole and so as to form said interior portion of the band extending longitudinally of the band inside the exterior portion;

causing said first end of the band to emerge through said hole in the exterior wall at said position to form the band into the loop with the first end of the band projecting out of said hole in the exterior wall so as to define a tail which can be pulled to tighten the loop;

and wrapping the loop around a plurality of toes of the patient so that the top loop portion including the exterior portion and the interior portion inside the exterior portion lies across the top of the plurality of toes and so that the bottom loop portion lies underneath the plurality of toes with the first side loop portion extending from the top of the toes alongside one toe to the bottom of the toes and with the second side loop portion extending from the top of the toes alongside another toe spaced from said one toe to the bottom of the toes.

2. The method according to claim 1 wherein the tubular member is formed of a fleece material with a pile layer on an inner surface.

3. The apparatus according to claim 1 wherein a resilient padding member is inserted into the hollow interior at least at the bottom loop portion.

4. The method according to claim 1 wherein the hole is a slit in the tubular material.

* * * * *